United States Patent [19]

McGannon

[11] 4,286,245

[45] Aug. 25, 1981

[54] MAGNETIC ROTARY FILE

[76] Inventor: Gloria J. McGannon, 2797 Stevens St., Oceanside, N.Y. 11572

[21] Appl. No.: 806,954

[22] Filed: Jun. 15, 1977

Related U.S. Application Data

[63] Continuation of Ser. No. 721,055, Sep. 7, 1976, abandoned.

[51] Int. Cl.[3] ..... G09F 11/04; H01F 7/02

[52] U.S. Cl. ..... 335/286; 40/377; 40/493

[58] Field of Search ..... 211/DIG. 1, 50, 164; 248/206 A, 206 R, 205; 206/425; 312/183, 186, 189; 40/68.6, 142 A; 335/285, 286, 295, 297, 298, 302, 306; 292/251.5

[56] References Cited

U.S. PATENT DOCUMENTS

| | | | |
|---|---|---|---|
| 2,219,186 | 10/1940 | Hornfeck | 292/251.5 X |
| 2,827,706 | 3/1958 | Fuller | 335/285 X |
| 2,947,507 | 8/1960 | Schlage et al. | 248/206 A |
| 3,232,654 | 2/1966 | Israelson et al. | 335/285 X |
| 3,260,006 | 7/1966 | Dunajew | 211/50 X |
| 3,403,933 | 10/1968 | Rossow | 292/251.5 |
| 3,408,771 | 11/1968 | Garrett et al. | 248/206 A X |
| 3,628,269 | 12/1971 | Dahl, Jr. | 40/142 A X |
| 3,918,017 | 11/1975 | McGannon et al. | 335/285 |

*Primary Examiner*—Roy D. Frazier
*Attorney, Agent, or Firm*—James P. Malone

[57] ABSTRACT

Rotary magnetic file including a base having a bottom and two sides. A shaft is mounted between said sides and a magnet is rotatably mounted on the shaft. A pair of magnetic members are mounted on said shaft at each side of said magnet. A pair of spacer members are mounted on said shaft on the outside of each magnetic members, the average diameter of the magnetic members being equal and less than the diameter of the spacer members. The edge of the spacer members adjacent to the magnetic members is gradually decreased to the dimension of the magnetic members. Index cards with clips of magnetic material may be mounted on said magnet and or magnetic members, the clips being formed to fit between the spacers in a self-centering manner.

1 Claim, 2 Drawing Figures

FIG 1
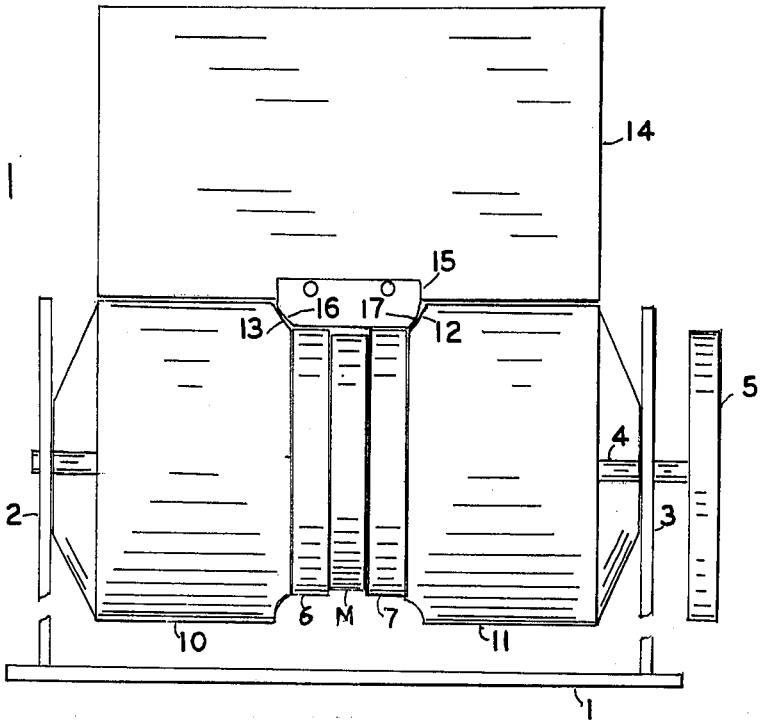
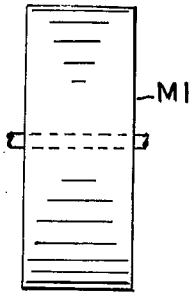
FIG 2

MAGNETIC ROTARY FILE

This is a continuation of application Ser. No. 721,055, filed Sept. 7, 1976.

This invention relates to magnetic article holding means, and more particularly to a rotary index card file.

This Application is an improvement over my U.S. Pat. No. 3,918,017, which shows a magnetic rotary file. U.S. Pat. No. 3,918,017 shows a magnet mounted on a shaft with two magnetic members also mounted on a shaft, the magnetic members having tapering edges so as to receive a small metal clip.

In further research and development of this device, it has been found that if the clip is large with respect to the axial dimension of the magnet, much greater holding power and efficiency can be developed with a smaller magnet.

The present invention shows a magnetic rotary file wherein the clip is as long or longer in the axial direction than the magnet. This provides the greatest holding power and efficiency.

Accordingly, a principal object of the invention is to provide new and improved magnetic rotary file means.

Another object of the invention is to provide new and improved magnetic holding means.

Another object of the invention is to provide new and improved magnetic holding means wherein the clips mounted on the index cards are as long or longer than the axial dimension of the magnet.

Another object of the invention is to provide a new and improved rotary magnetic file comprising, a base having a bottom and two sides, a shaft mounted between said sides, a magnet mounted on said shaft, a pair of magnetic members, one mounted on said shaft at each side of said magnet, the magnet and the magnetic members being rotatable with respect to said sides, a pair of spacer members, one mounted on said shaft on the outside of each magnetic members, the average diameter of the magnet and magnetic members being less than the diameter of the spacer members, the edge of the spacer members adjacent to the magnetic members being gradually decreased to the dimension of the magnetic members, and a plurality of clips of magnetic material mounted on said magnet and magnetic members, the clips being formed to fit between the spacers in a self-centering manner.

These and other objects of the invention will be apparent from the following specification and drawings, of which:

FIG. 1 is a side view of the embodiment of the invention.

FIG. 2 is a detail view of a modification of the invention.

Referring to the drawings, the rotary magnetic file of the present invention comprises a base 1, having a pair of side members 2 and 3. A shaft 4 is mounted between the side members and has a rotary knob 5. Another knob may be mounted on the other side if desired. A magnet M is mounted on the shaft 4. The magnet preferably has a disc shape with a round cross-section and the magnet is mounted so that it is rotatable with respect to the side members. The magnet is preferably fixed to the shaft and the shaft rotates to the side members. Mounted on the shaft 4 on either side of the magnet are two magnetic members 6 and 7 having similar disc shapes. The magnet is preferably thinner than magnetic members 6 and 7 and of smaller diameter.

Mounted on the shaft 4 on either side of the members 6 and 7 are a pair of spacer members 10 and 11. The spacer members may be of wood or plastic and have a round cross-section. The diameter of the spacer members is larger than that of the magnet and the magnetic members 6 and 7, and the edges 12 and 13 of the spacer member adjacent the magnetic members 6 and 7 have a taper or slightly curved configuration. The magnetic members 6 and 7 may be of iron, steel or any equivalent material which will carry the magnetic field from the magnet M.

The index cards 14 each have a clip 15 of iron or other magnetically responsive material. The edges 16 and 17 of the clip 15, have tapering or slightly curved configurations so as to fit between the edges 12 and 13 of the spacer members.

The clip 15 axial dimension will be less than the distance between 12 and 13, so as to fit between them.

Therefore, the cards may be inserted in the file by inserting the clips 15 between the edges 12 and 13 of the spacer members. This provides a mechanical self-centering action. The clips 15 will then be held magnetically by the magnetic file the magnet M and the magnetic members 6 and 7. The dimension of the clip 15 in the axial direction is somewhat shorter than the axial dimension between the spacers. This provides the greatest magnetic efficiency and enables the maximum number of cards to be held with a minimum sized magnet.

FIG. 2 shows another embodiment of the invention wherein the magnetic holding member may be a solid magnet M1 and the magnetic members 6 and 7 eliminate. However, the embodiment of FIG. 1 is preferred as it is more economical and substantially as efficient as the embodiment of FIG. 2.

Multiple assemblies as in FIGS. 1 or 2 may be mounted along the same shaft for holding large cards or articles.

I claim:

1. Rotary magnetic file comprising:

a base having a bottom and two sides, a shaft mounted between said sides, a magnet mounted on said shaft, a pair of magnetic members, one mounted on said shaft, at each side of said magnet, the magnet and the magnetic members being rotatable with respect to said sides, a pair of spacer members, one mounted on said shaft on the outside of each magnetic members, the average diameter of the magnet and magnetic members being less than the diameter of the spacer members, the edges of the spacer members adjacent to the magnetic members being gradually decreased to the dimension of the magnetic members, and a plurality of clips of magnetic material mounted on said magnet and magnetic members, the clips being formed to fit between the spacers in a self-centering manner, the dimension of the clips in the axial direction of the magnet being several times larger than the magnet.

* * * * *